US005380407A

United States Patent [19]

Yamaoka et al.

[11] Patent Number: 5,380,407

[45] Date of Patent: Jan. 10, 1995

[54] METHOD FOR FACILITATING DISTINCTION BETWEEN DIFFERENT STEEL PRODUCTS

[75] Inventors: Yukio Yamaoka, Sakai; Keiji Hattori, Kobe; Masaru Kodama, Amagasaki; Hirofumi Ueki, Kobe, all of Japan

[73] Assignee: Shinko Kosen Kogyo Kabushiki Kaisha, Amagasaki, Japan

[21] Appl. No.: 139,166

[22] Filed: Oct. 21, 1993

Related U.S. Application Data

[62] Division of Ser. No. 937,696, Sep. 1, 1992, abandoned.

[30] Foreign Application Priority Data

Dec. 25, 1991 [JP] Japan ..... 3-343511

[51] Int. Cl.[6] ..... C25D 5/50

[52] U.S. Cl. ..... 205/122; 205/177; 205/181; 205/182

[58] Field of Search ..... 205/177, 181, 182, 240, 205/122

[56] References Cited

U.S. PATENT DOCUMENTS 3,954,420 5/1976 Hyner et al. ..... 29/183.5
3,966,183 6/1976 Mayer, Sr. ..... 267/167
4,013,488 3/1977 Ramqvist et al. ..... 148/143
4,417,956 11/1983 McCoy ..... 205/177
4,791,025 12/1988 Hiromori et al. ..... 428/379
4,859,289 8/1989 Nishimura et al. ..... 205/240

*Primary Examiner*—John Niebling
*Assistant Examiner*—Brendan Mee
*Attorney, Agent, or Firm*—Oblon, Spivak, McClelland, Maier & Neustadt

[57] ABSTRACT

Facilitating the distinction among different spring steel products and at the same time improving their surface appearance and corrosion resistance by plating the surface of said different spring steel products before spring-forming with either alternate layers of Cu and Zn or alternate layers of Ni, Cu and Zn, the amount of Cu and Zn differing for steel products differing in size and/or material, to obtain color-developable spring steel products, drawing and taken coil spring-forming the resulting plated spring steel products, and low temperature annealing said resulting plated spring steel products to develop their colors, the colors being different for spring steel products differing in size and/or material, whereby mixing and erroneous assembly of spring steel products differing in size and/or material is prevented.

9 Claims, 4 Drawing Sheets

METHOD FOR FACILITATING DISTINCTION BETWEEN DIFFERENT STEEL PRODUCTS

This is a division, of application Ser. No. 07/937,696, filed on Sep. 1, 1992 now abandoned.

BACKGROUND OF THE INVENTION

1. Field of the Invention:

The present invention relates to color-developing plated metal for springs and the method of using the same, and more specifically, to a color-developing plated metal for springs capable of being suitably distinguished in size, material and the like and the method of using the same.

2. Description of the Prior Art

A product formed of spring steel (that is, a spring) such as a coil spring or a sheet spring is used in various applications such as mechanical parts, official materials and daily necessities. The spring steel as a material for the above spring includes a spring steel wire and a spring steel sheet. As the spring steel wire, there are known a hard drawn steel wire, a piano wire and a spring stainless steel wire specified in Japanese Industrial Standard (hereinafter referred to as JIS).

These steel wires resemble each other in surface color tone, and particularly, a hard drawn steel wire cannot be distinguished from a piano wire by only the color tone. Also, in the case of a stainless steel wire, it generally is more lustrous as compared to a hard drawn steel wire and a piano wire; however, when being finished by oil drawing (wet drawing), it cannot be distinguished by color tone. Accordingly, of these steel wires after spring-forming, those resembling in size to each other have often created a problem of their mixing in size or material, and consequently, the defective spring product being liable to be erroneously assembled in a mechanical structure.

On the other hand, a steel cord for reinforcing a radial tire of an automobile is formed as follows: namely, five elementary wires each having a diameter of, for example, 0.25 mm are stranded, and the stranded wire is knitted into a belt-shape and is disposed around the periphery of the tire. Thus, the steel cord aims at reinforcement of the radial tire as a rubber-metal cord composite material. The above elementary wire is manufactured by the steps of: applying a Cu-plating as a lower layer and a Zn-plating as an upper layer on the surface of a raw wire having a diameter of 1.3mm at a plating thickness ratio of Cu:Zn=7.3; heating the plated wire at approximately 400° C. for a few minutes to tens of minutes for alloying the plating layers into a Cu-30% Zn alloy; and forcibly drawing it at a reduction ratio of 96.3% to a diameter of 0.25 mm. During such processes, after heating, the color of the plating surface is changed from white to gold, which exhibits a very beautiful color tone.

In the manufacture of a steel wire mentioned above, the fact that the surface color tone of the cord is changed to gold is worthless, and the object is to improve the drawability and adhesiveness between rubber and metal by alloying the plating layer into a Cu-30% Zn alloy. Accordingly, the positive function of the coloring generated by plating the material with two different metals and applying thermal diffusion thereto was not recognized.

In addition, the steel coated with only a plating layer of Cu-30% Zn alloy has no problem in terms of corrosion resistance when it is embedded in rubber, for example, as in the case of the steel cord and thus shielded from the outside air. However, in the case of using the above steel as a formed product without shielding it from the outside air, it is insufficient for corrosion resistance and results in problems.

To prevent the above products formed of spring steel of different size and material form mixing and also to improve their beautiful appearance, there have been used the following coatings on the spring steel wire: various resin film coatings; baked coatings of paint; ion plating by PVD or CVD; and TiN coating.

However, in spring-forming, the spring steel wire is subjected to severe abrasion close to galling in passing through the forming tool, and is also subjected to a heat treatment (low temperature annealing) at 250° C.–400° C. for 2–10 min. after spring-forming for improving the spring characteristics. Consequently, the spring steel wire coated with a resin film or baking paint is liable to be damaged on the surface thereof during the spring-forming thereby causing peeling of the film, and also the film is softened during the low temperature annealing thus causing depressions in the film and mutual adhesion of the springs. The spring steel wire plated by ion plating does not result in the above problems; but has a disadvantage of increasing the cost. Therefore, the known techniques do not function in an adequate manner.

SUMMARY OF THE INVENTION

An object of the present invention is to facilitate the distinction among the spring steel products and to improve their surface appearance, and further to improve their corrosion resistance.

To achieve the above object, the present inventors have found that plating does not significantly deteriorate the spring characteristic of the spring steel material and improves the corrosion resistance, and further causes the plating layer to be colored during the low temperature annealing after the spring-forming, and therefore, by suitable selection of the color tone of the spring steel product, it is possible to distinguish them by size and material.

In a first aspect of the present invention, there is provided coated metal for a spring having alternate plating layers of Cu and Zn on the surface thereof, which are alloyed by a low temperature thermal diffusion after the spring-forming on the surface thereof.

In a second aspect of the present invention, there is provided a method of using said plated metal for a spring comprising the steps of: plating alternate layers of Cu and Zn with a thickness ratio of the Zn layer to the whole thickness of the plating layers at 5–45% on the surface of a spring steel wire; adjusting the final plating thickness at 2–25 μm, and spring-forming it; and heating the formed product at 250°–400° C. (low temperature annealing), thereby coloring the plating layer thereof.

In a third aspect of the present invention, there is provided plated metal for a spring having a Ni-plating layer on the surface thereof and subsequent alternate layers of Cu and Zn to be alloyed by a low temperature thermal diffusion after the spring-forming.

In a fourth aspect of the present invention, there is provided a method of using the said coated metal for a spring comprising the steps of: applying a three-layer plating of a Ni-layer as a lower layer, a Cu-layer as an intermediate layer and a Zn-layer as an upper layer, adjusting a thickness ratio of the Zn layer to the total thickness of the Cu-layer and Zn layer at 5–45% on the surface of a spring steel wire; adjusting the Ni-layer thickness and the total thickness of Cu-layer and Zn layer at 2–30μm and 2–25μm, respectively, and spring-forming it; and heating the formed product at 250°–400° C. (low temperature annealing), thereby coloring the plating layer thereof.

Prior to description of the preferred embodiments, there will be described the function of the present invention.

A Cu-Zn alloy plating layer alloyed by heating of two-layer plating of Cu-Zn can exhibits various color tones according to the heating conditions and the content of Zn, which makes easy the distinction thereof.

Further, a three-layer plating of a lower Ni-layer, an intermediate Cu-layer, and an upper Zn-layer, when it is heated at a relatively low temperature so as not to yield mutual diffusion between the lower Ni-layer and the intermediate Cu-layer, the intermediate Cu-layer and the upper Zn-alloy are alloyed by the mutual diffusion, to thus form a Cu-Zn alloy placing layer. This can exhibit various color tones according to the heating conditions and the content of Zn, thus making easy the distinction thereof.

The present invention is intended to prevent the mixing of the products formed of spring steel different in size and material by utilizing the difference in the color tone of the color developing plating layer, and to improve the corrosion resistance by the Cu-Zn alloy plating layer and Ni-plating layer as a lower layer. However, if the characteristic of the product formed of spring steel is significantly deteriorated in use due to the presence of the color-developing plating layer present for distinction, it cannot be put to practical use. Accordingly, the color-developing plating layer is intended to be in the optimal condition. Also, the Ni-plating layer as a lower layer is present in the optimal condition. The present invention has been completed as a result of close investigation of the optimal conditions with regard to the distinction among products, the spring characteristic and corrosion resistance. Hereinafter, this will be specifically described with reference to the accompanying drawings.

A hard drawn steel wire is plated with a two-layer plating (lower layer: Cu, upper layer: Zn) at a ratio of the thickness of the upper Zn-layer to the whole plating thickness of 30% and is drawn and formed into a coil spring. The formed hard drawn steel wire is heated under various conditions of temperatures and times and is then examined for change in color tone of the plating surface, which gives the results as shown in FIG. 1.

Further, a hard drawn steel wire is plated with a three-layer plating (lower layer: Ni, intermediate layer: Cu, upper layer: Zn) at a ratio of the thickness of the Zn-layer to the total plating thickness of the Cu-layer and the Zn-layer of 30%, and is drawn and formed into a coil spring. The formed hard drawn steel wire is heated under the same conditions as those in the above case plated with the two-layer plating and is then examined for change in color tone of the plating surface, which gives the same results as shown in FIG. 1.

The change in color tone is closely dependent on the heating temperature and the heating time. There almost instantaneously occurs a color change from white to gold capable of being distinguished by the naked eye under the following condition: in the temperature range of the practical low temperature annealing (250°–400° C.), when being at 250° C., the healing time is 4 min. or more, and when being at 400° C., the heating time is 2 min. or more.

As a result of such experiments, the heating time <t> required for generating the above color change in a temperature T (° C.) within the range of 250°–400° C. is expressed as the following equation (1).

$$\log t \geqq 1.193 - 2{,}386 \times 10^{-3} T \quad (1)$$

Further, the hard drawn steel wire is plated with the same two-layer plating as the above at various plating thicknesses, and is drawn and spring-formed in the same manner as the above. The resultant hard drawn steel wire is then heated at 400° C. for 5 min. or more to form a Cu-Zn alloy plating layer, which gives the relationship between the content of Zn(%) in the alloy and the color tone as shown in FIG. 2.

Also, the hard drawn steel wire is plated with the same three-layer plating as the above at various plating thicknesses, and is drawn and spring-formed in the same manner as the above. The resultant hard drawn steel wire is then heated at 400° C. for 5 min. or more for alloying Cu in the intermediate layer and Zn in the upper layer by mutual diffusion to thus form a Cu-Zn alloy plating layer, which gives the same relationship as that in the case plated with the two-layer plating.

Referring to FIG. 2, in the range of 20–45% of Zn, there appears the beautiful color tone of gold functioning to distinguish and preventing the mixing of the different materials, and which also significantly improves the surface appearance. Further, in the range of 5–10% Zn, there appears the color tone strongly affected by the color of Cu (red copper color) of a plating component, which is significantly different from the color of white (color of Zn) of the as-plated surface, and consequently, the spring thus treated is sufficiently distinguished from the ordinary spring having the surface colored in white (color of metal), it thus having a practical use.

One of the important properties of the product formed of spring steel lies in the corrosion resistance. From this viewpoint, the spring plated with the same two-layer plating as shown in FIG. 2 is examined,which gives a relationship between the Zn (%) in a Cu-Zn alloy plating layer and the rusting time (the time when the material becomes corroded) by a salt spray test using a solution containing 3% salt. The results are shown in FIG. 3. It is evident from this Figure that at a plating layer thickness of 2 μm or more, the corrosion resistance is improved with increase in Zn content (%), and at a Zn content of 5–45%, the rusting time is made longer as compared with the non-plated hard drawn steel wire. It is apparent that the presence of the plating layer does not deteriorate the characteristic of the spring material but preferably improves it. At a plating layer thickness of 1 μm, the plating layer is affected by the irregularities of surface of the spring material, thus exerting no effect on improvement of the corrosion resistance. In addition, when using a SUS 304 stainless steel wire in place of the hard steel drawn wire as a spring wire, the rusting time is obtained by adding the value as shown in FIG. 3 to the rusting time (185 hrs.) of the SUS 304 stainless steel spring itself.

Further, the spring plated with the same three-layer plating as the above is examined, which gives a relationship between the Zn (%) in a Cu-Zn alloy plating layer and the rusting time (the time the material becomes corroded) on the different thicknesses of the alloy plating layer and the lower Ni-layer, by a salt spray test using a solution containing 3% salt. The results are shown in FIG. 3. It is evident from this Figure that the corrosion resistance is improved by the presence of the Cu-Zn alloy plating layer, the rusting time is made longer with increase in Zn content thus improving the corrosion resistance. In particular, at a Zn content of 10% or more, the corrosion resistance is preferably improved, and the thickness thereof is preferably 2 μm or more. As for the lower Ni-plating layer, the thickness thereof is preferably 2 μm or more. In the case of the Cu-Zn alloy plating layer of 1 μm and the lower Ni-plating layer of 1 μm, the plating layer is affected by the irregularities of surface of the spring material which decreases the effect of improving the corrosion resistance. Preferably, each thickness of the Cu-Zn alloy plating layer and the lower Ni-layer is 2 μm or more. The corrosion resistance is enhanced with increase in each thickness. However, when the thicknesses of the Cu-Zn alloy plating layer and the Ni-plating layer exceed 25 μm and 30 μm, respectively, the corrosion resistance is not enhanced in proportion to the increase in the thicknesses. Accordingly, economically, the thicknesses of the Cu-Zn alloy plating layer and the Ni-plating layer are respectively 25 μm or less and 30 μm or less, respectively.

Hard drawn steel wire material of 3.5 mm is plated with a two-layer plating of Cu-Zn and is drawn at a reduction ratio of 91.7% to a diameter of 1 mmϕ, after which it is heated at 400° C. for 5 min. to be thus alloyed. Similarly, a stainless steel wire material of 2.5 mmϕ is plated with a two-layer plating and is drawn at a reduction ratio of 84% to a diameter of 1 mmϕ, after which it is heated under the same condition as the above, to be thus alloyed. FIG. 4 shows a relationship between the Hunter's rotational bending fatigue strength and Zn content (%) with respect to the above wire materials. The hard drawn steel wire and the stainless steel wire are not reduced in fatigue strength at the plating layer thickness of 25 μm or less; however, they are apparently reduced in fatigue strength at the plating layer thickness of 30 μm. Accordingly, in practical use, the plating thickness is, preferably, less than 30 μm. The same is true for the coil spring (spring steel product).

The above data is obtained for the spring steel material being a wire and the product formed of spring steel being a coil spring; however, the data is almost similar to that in the case of the spring steel material being a sheet and the product formed of spring steel being a sheet spring.

In summary, in the two-layer plating of Cu-Zn for the product formed of a spring steel, the following condition is preferable: the Cu-Zn alloy composition is within the range of 4–45% Zn in view of the color tone effect; the plating thickness is 2 μm or more in view of corrosion resistance, and is 25 μm or less in view of preventing reduction in fatigue strength; and the low temperature annealing condition for coloring is 250° C.×4 min. or more to 400° C.×2 min. or more.

Further, in the three-layer plating (lower layer: Ni, intermediate layer: Cu, upper layer: Zn) for the product formed of a spring steel, the thickness of the lower Ni-layer is preferably 2 μm or more in view of the corrosion resistance, and 30 μm or less in view of economy. In a color Cu-Zn alloy plating layer, the following condition is preferable: the Cu-Zn alloy composition is within the range of 10–45% Zn in view of the color tone effect; the plating thickness is 2 μm or more in view of the corrosion resistance, and is 25 μm or less in the view of economy; and the low temperature annealing condition for coloring is 250° C.×4 min. or more to 400° C.×2 min. or more.

The color developing coated metal for springs and the method of using the same according to the present invention is made in consideration of the above condition. Accordingly, it is possible to achieve the color tone effect of the color Cu-Zn alloy plating layer without deteriorating the spring characteristic thereby facilitating the distinction among spring steel formed products, and also to improve the surface appearance. Further, it is possible to improve the corrosion resistance by the Cu-Zn alloy plating layer and the lower Ni-plating layer.

In addition, the method of using coated metal according to the present invention is made to satisfy the above condition and comprises the steps of: applying two-layer plating (lower layer: Cu, upper layer: Zn) or three-layer plating (lower layer: Ni, intermediate layer: Cu, upper layer: Zn) on the surface of the spring steel material; spring-forming it; heating the formed steel at 250°–400° C. (low temperature annealing) thereby making the plating layer becoming colored, to thus obtain the color-developing coated metal according to the present invention. However, the color-developing coated metal for springs may be obtained by other methods. For example, by a method comprising the steps of: heating the above spring material at 250°–400° C. for making the plating layer colored, and then spring-forming it, followed by annealing; but this method makes the manufacturing processes complex because of adding one process step, that is, a heating process step. Consequently, in the present method, the plating layer is colored by the low temperature annealing indispensable after the spring-forming process, and therefore, the present invention is simple in the manufacturing processes and hence is economically excellent.

DETAILED DESCRIPTION OF THE PREFERRED EMBODIMENTS

Figure 1:
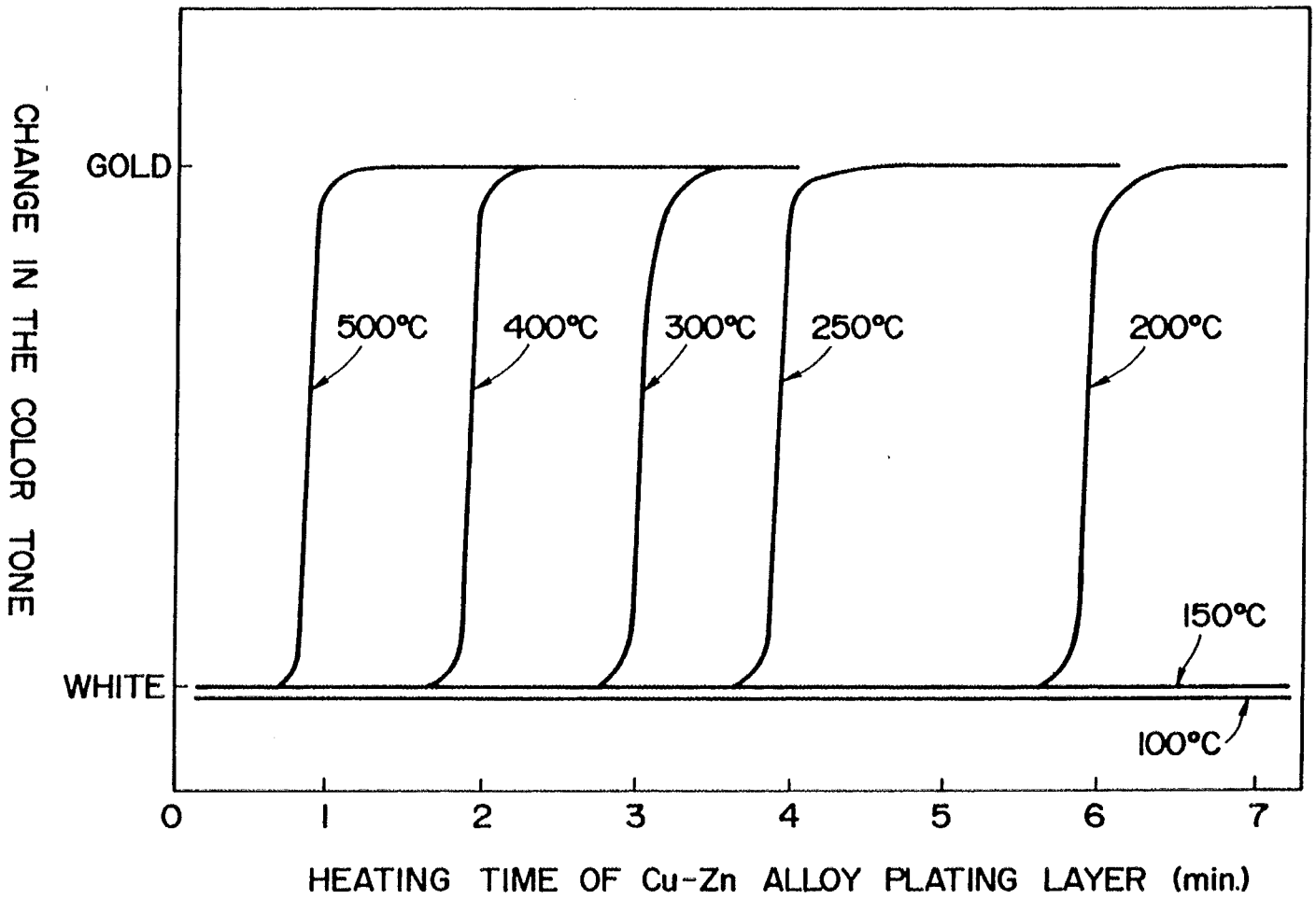
FIG. 1 is a view for explaining the relationship between the heating time and temperature, and color tone change in a Cu-Zn plating layer of a spring formed product.
Figure 2:
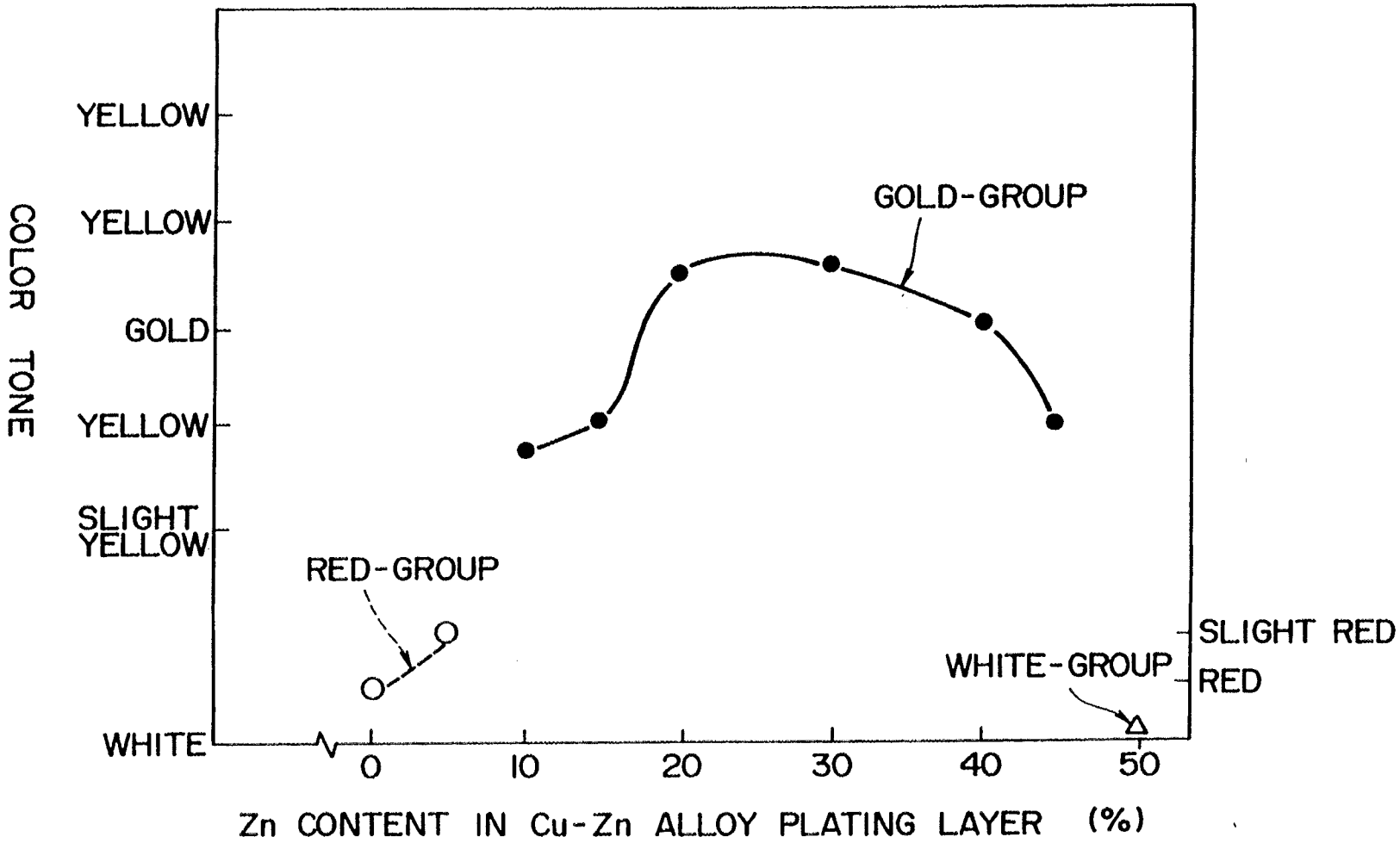
FIG. 2 is a view for explaining the relationship between the Zn content and the color tone in a Cu-Zn plating layer of a Spring formed product.
Figure 3:
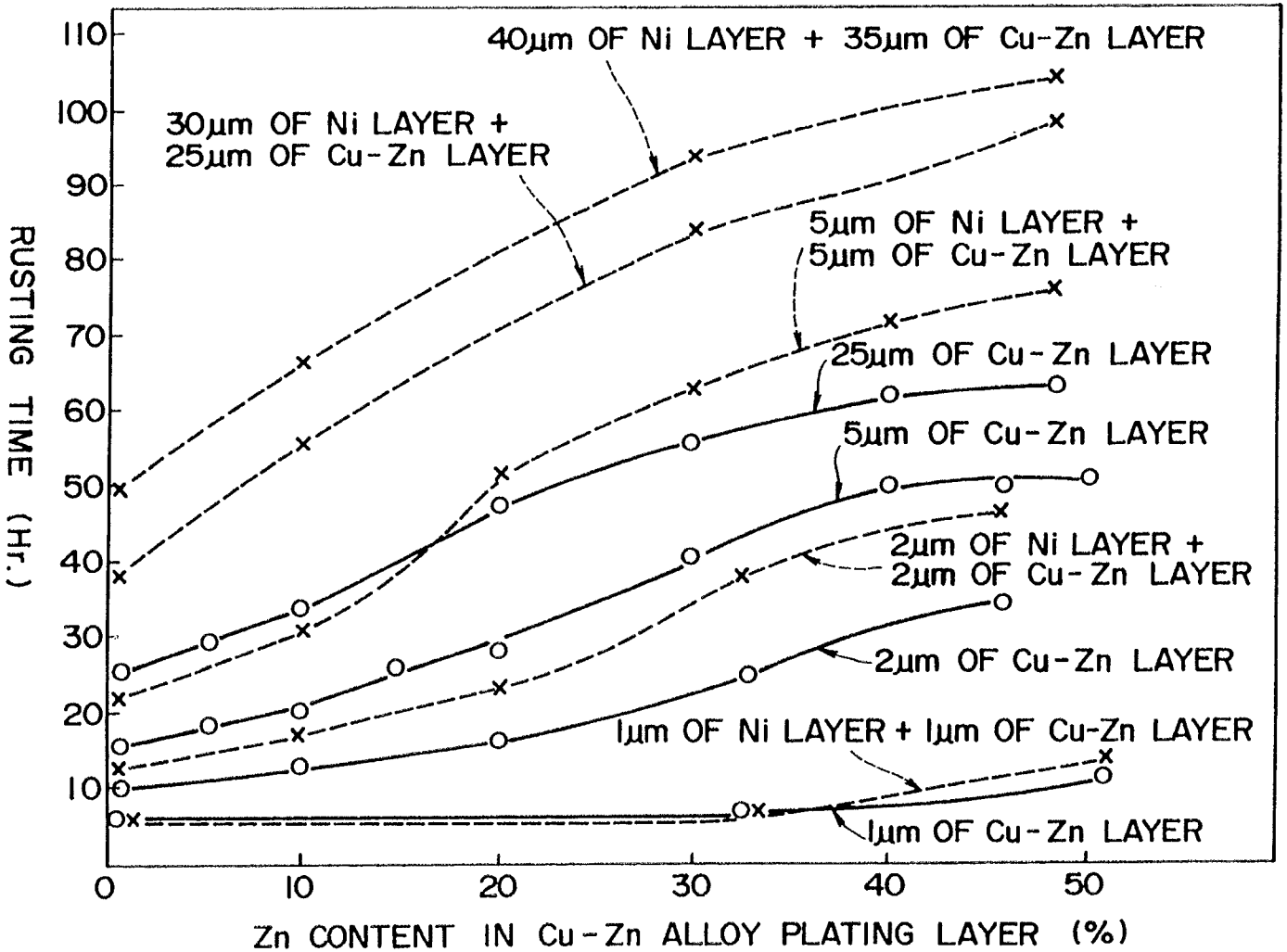
FIG. 3 is a view for explaining the relationship between the Zn content, and the rusting time in a Cu-Zn plating layer of a Spring formed product concerning different plating layer thickness.
Figure 4:
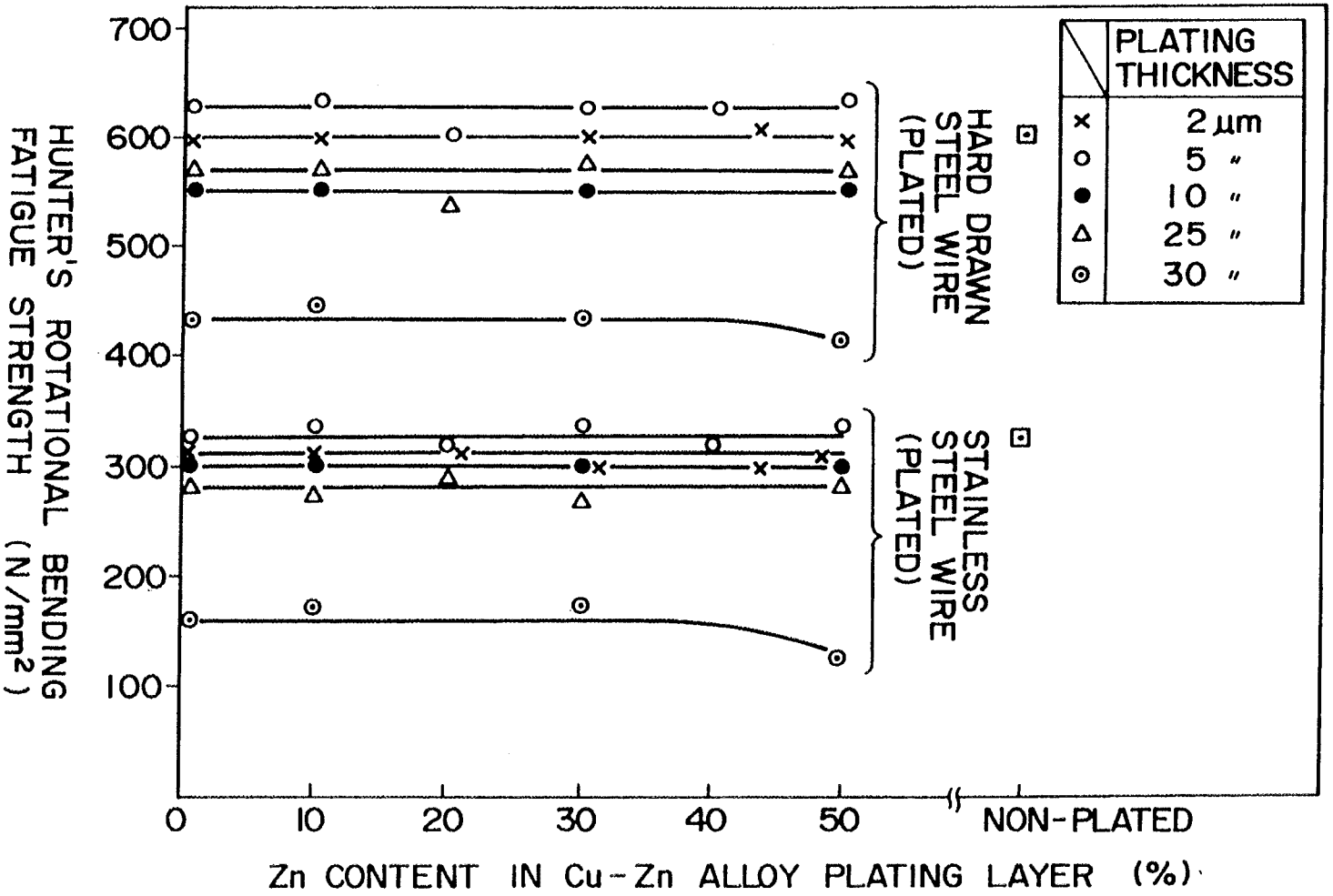
FIG. 4 is a view for explaining the relationship between the Zn content and the Hunter's rotational fatigue strength in a Cu-Zn plating layer of a spring formed product with different plating layer thickness.

Hereinafter, the exemplary embodiments will be described with reference to the accompanying drawings.

EXAMPLE 1

A hard drawn steel wire containing 0.82% C was subjected to lead parenting, pickling and descaling to thus form a raw wire of 3.5 mmϕ. The raw wire was plated with two-layer plating of a lower layer of Cu and an upper layer of Zn using a two-bath continuous electro-plating bath. In this case, Cu plating was applied under the following conditions: bath composition is $CuSO_4$:130g/l and 62% $H_2SO_4$: 33cc/l solution; pH is 1.5; temperature is 30° C.; plating current density is 5A/dm$^2$; and anode is Cu plate. Zn plating was applied under the following condition: bath composition is $ZnSO_4 \cdot 7H_2O$; 410 g/l, $AlCl_3 \cdot H_2O$: 20g/l, and $Na_2SO_4L$ 75g/l solution; pH is 4; current density is 5A/dm$^2$; and anode is Zn plate. The plating times were set at five values for changing the Zn thickness ratio to the whole thickness: namely, 0, 5, 30, 45, and 50%. At the same time, the whole plating thickness was adjusted to become 2 μm, 25 μm and 30 μm after drawing.

After being plated with the two-layer plating, the raw wire was drawn 8 times in the usual manner at a reduction ratio of 91.7% to a diameter of 1 mmϕ, to thus obtain an elementary wire within a strength level equivalent to 1 mmϕ of JIS 3521 hard drawn steel wire SWC. The elementary wire of 1 mmϕ was formed into tight springs having an outside diameter of 10 mm, length of 20 mm and a number of winding of 20. Each tight spring was heated at 150° C.×7 min., 200° C.×5 min., 250° C.×4 min., 300° C.×3.5 min., and 400° C.×2 min., and was examined for the colored state. Each tight spring after being heated was cooled and was examined for corrosion resistance by a salt spray test. Also, the elementary wire of 1 mm was subjected to the same heat treatment as the above, which was measured for tensile strength, torsion value and fatigue strength. The results are shown in Table 1.

As a comparative example, the bare wire of 1 mmϕ formed by drawing the above raw wire of 3.5 mmϕ, and the polyester coating elementary (color tone: red) wire was tested in the same manner as the above. The polyester coating elementary wire was formed by drawing the patented steel wire of 3.5 mmϕ to a diameter of 1 mmϕ and dipping it in a solution formed by diluting polyester paint by thinner, followed by baking by a two-bake/two-coat system. The results are shown in Table 1.

TABLE 1

| Material | Plating thickness (μm) Total | Cu | Zn | Zn in plating after heating (%) | Wire diameter (mm) | Tensile strength (N/mm$^2$) | Torsion test: Torsion value | Fracture surface | Fatique strength (N/mm$^2$) | Rusting time in salt spray (hr) | Remarks |
|---|---|---|---|---|---|---|---|---|---|---|---|
| Hard steel wire (SWC) | 2 | 2 | 0 | 0 | 1.0 | 2120 | 25 | good | 580 | 10 | Comparative Example |
| | 2 | 1.9 | 0.1 | 5 | 1.0 | 2100 | 22 | good | 570 | 12 | Working Example |
| | 2 | 1.4 | 0.6 | 30 | 1.0 | 2110 | 22 | good | 570 | 25 | |
| | 2 | 1.1 | 0.9 | 45 | 1.0 | 2090 | 28 | good | 565 | 35 | |
| | 2 | 1.0 | 1.0 | 50 | 1.0 | 2090 | 24 | good | 570 | 39 | Comparative Example |
| | 25 | 25 | 0 | 0 | 1.0 | 2070 | 27 | good | 560 | 25 | Working Example |
| | 25 | 23.75 | 1.25 | 5 | 1.0 | 2040 | 24 | good | 560 | 27 | |
| | 25 | 17.5 | 7.5 | 30 | 1.0 | 2060 | 24 | good | 570 | 55 | |
| | 25 | 13.75 | 11.25 | 45 | 1.0 | 2060 | 25 | good | 560 | 60 | |
| | 25 | 12.5 | 12.5 | 50 | 1.0 | 2040 | 25 | good | 565 | 60 | Comparative Example |
| | 30 | 30 | 0 | 0 | 1.0 | 2030 | 23 | good | 400 | 30 | |
| | 30 | 28.5 | 1.5 | 5 | 1.0 | 2010 | 26 | good | 420 | 32 | |
| | 30 | 21.0 | 9.0 | 30 | 1.0 | 2000 | 27 | good | 400 | 55 | |
| | 30 | 16.5 | 13.5 | 45 | 1.0 | 2010 | 26 | good | 410 | 65 | |
| | 30 | 15.0 | 15.0 | 50 | 1.0 | 2040 | 26 | good | 420 | 65 | |
| Bare wire *1 | — | — | — | *2 | 1.0 | 2170 | 24 | good | 590 | 5 | |
| | — | — | — | *2 | 1.2 | 2160 | 27 | good | 585 | *3 | |

(Note)
*1 . . . polyester coat wire
*2 . . . no heating
*3 . . . no rust after 300 hr

EXAMPLE 2

A stainless steel wire for a spring is subjected to bright annealing to be softened, to thus form a raw wire of 2.5 mmϕ. The raw wire was plated with a two-layer plating and drawn in the same manner as in Example 1. The elementary wire of 1 mmϕ was formed into a coil spring and heated, which was subjected to the same test as in Example 1.

Also, as a comparative example, the bare elementary wire of 1 mmϕ formed by drawing the raw wire of 2.5 mmϕ was tested. The results are shown in Table 2.

As is apparent from Tables 1 and 2, with a plating thickness ranging from 2 to 25 μm, either of the tensile strength, torsion value characteristic, fatigue strength or corrosion resistance is preferable as an elementary wire for a spring. However, with a plating layer thickness of 30 μm, the fatigue strength is significantly reduced, thus not having a practical use. The polyester coating elementary wire is excellent in corrosion resistance.

TABLE 2

| Material | Plating thickness (μm) Total | Cu | Zn | Zn in plating after heating (%) | Wire diameter (mm) | Tensile strength (N/mm$^2$) | Torsion test: Torsion value | Fracture surface | Fatique strength (N/mm$^2$) | Rusting time in salt spray (hr) | Remarks |
|---|---|---|---|---|---|---|---|---|---|---|---|
| Stainless steel wire for spring (WPB) | 2 | 2 | 0 | 0 | 1.0 | 1970 | 12 | good | 310 | 200 | Comparative Example |
| | 2 | 1.9 | 0.1 | 5 | 1.0 | 1960 | 10 | good | 300 | 200 | Working Example |
| | 2 | 1.4 | 0.6 | 30 | 1.0 | 1950 | 8 | good | 315 | 220 | |
| | 2 | 1.1 | 0.9 | 45 | 1.0 | 1960 | 9 | good | 300 | 225 | |
| | 2 | 1.0 | 1.0 | 50 | 1.0 | 1960 | 10 | good | 310 | 230 | Comparative Example |
| | 25 | 25 | 0 | 0 | 1.0 | 1940 | 10 | good | 290 | 210 | Working Example |
| | 25 | 23.75 | 1.25 | 5 | 1.0 | 1940 | 12 | good | 290 | 220 | |
| | 25 | 17.5 | 7.5 | 30 | 1.0 | 1930 | 10 | good | 295 | 240 | |
| | 25 | 13.75 | 11.25 | 45 | 1.0 | 1920 | 8 | good | 290 | 250 | |

TABLE 2-continued

| Material | Plating thickness (μm) Total | Cu | Zn | Zn in plating after heating (%) | Wire diameter (mm) | Tensile strength (N/mm²) | Torsion test Torsion value | Fracture surface | Fatique strength (N/mm²) | Rusting time in salt spray (hr) | Remarks |
|---|---|---|---|---|---|---|---|---|---|---|---|
| | 25 | 12.5 | 12.5 | 50 | 1.0 | 1940 | 7 | good | 300 | 250 | Comparative |
| | 30 | 30 | 0 | 0 | 1.0 | 1910 | 6 | good | 180 | 218 | Example |
| | 30 | 28.5 | 1.5 | 5 | 1.0 | 1900 | 12 | good | 195 | 220 | Working |
| | 30 | 21.0 | 9.0 | 30 | 1.0 | 1900 | 10 | good | 190 | 240 | Example |
| | 30 | 16.5 | 13.5 | 45 | 1.0 | 1910 | 11 | good | 190 | 250 | |
| | 30 | 15.0 | 15.0 | 50 | 1.0 | 1920 | 12 | good | 180 | 250 | Comparative |
| Bare wire | — | — | — | — | 1.0 | 1970 | 10 | good | 310 | 190 | Example |

EXAMPLE 3

In the elementary wire as shown in Example 1, the whole plating thickness after drawing was set to be 5 μm instead of 2 μm. It was formed into a coil spring, followed by heating, and was examined for a colored state. Similarly to Example 1, the thickness ratio of Zn in the alloy plating layer was made at 0, 5, 30, 45, and 50%. As is apparent from Table 3, when the plating thickness ratio of Zn layer in two-layer plating is adjusted to the extent that the Zn content in the alloy plating layer is within the range of 5–45%, the color tone is significantly changed by the heat treatment, and consequently, by the use of this color change, it is possible to positively distinguish the spring steel formed products. Also, the present invention is superior compared to when using a resin coating because the resin coating suffers from surface deterioration, such as galling in forming, decoloration and fusing. In addition, in the case of the coil spring in Example 2, (elementary wire: stainless steel wire), when the plating thickness ratio of Zn layer in the two layer plating was adjusted to the extent that the Zn content was within the range from 2 to 45% similarly to the above, the color tone was similarly changed.

The present invention is not limited to a coil spring; but may be applied for a spring material that requires a low temperature annealing after forming (forming material, torsional spring and sheet spring and the like) or the material similar thereto.

EXAMPLE 4

A hard drawn steel wire containing 0.82% was subjected to lead parenting, pickling and descaling to thus form a raw wire of 3.5 mmϕ. The raw wire was plated with a three-layer plating of a lower layer of Ni, an intermediate layer of Cu and an upper layer of Zn using a three-bath continuous electro-plating bath. In this case, Ni plating was applied under the following condition: bath composition is nickel sulfamic acid: 450g/l, nickel chloride: 15g/l and boric acid: 30g/l; pH is 4; temperature is 50° C.; and plating current density is 8A/dm². Cu-plating was applied under the following condition: bath composition is $CuSO_4$130g/l and 62% $H_2SO_4$:33cc/l solution; pH is 1.5; temperature is 30° C.; plating current density is 5A/dm²; and anode is Cu plate. Zn plating was applied under the following condition: bath composition is $ZnSO_4 \cdot 7H_2O$: 410g/l, $AlCl_3 \cdot HO$: 20g/l, and $Na_2SO_4$: 75g/l solution; pH is 4; current density is 5A/dm²; and anode is Zn plate. The plating times were set at five values for changing the Zn-layer thickness ratio to the total thickness of Cu-layer and Zn-layer: namely, 0, 5, 10, 45, and 50%. At the same time, the total plating thickness of Ni-plating layer, Cu-layer and Zn-layer was adjusted to become 0, 1, 2, 5, 25 and 30μm after drawing.

After being plated with a three-layer plating, the raw wire was drawn 8 times in the usual manner at a reduction ratio of 91.7% to a diamener of 1 mmϕ, to thus obtain an elementary wire within a strength level equivalent to 1 mmϕ of JIS 3521 hard drawn steel wire SWC. The elementary wire of 1 mmϕ was formed into tight springs having an outside diameter of 12 mm, length of 20 mm and a number of winding of 20. Each tight spring was heated under a condition of 150° C.×7 min., 200° C.×5 min., 250° C.×4 min., 300° C.×3.5 min., and 400° C.×2 min., which was examined for the colored state. Each tight spring after being heated was cooled and was examined for corrosion resistance by a salt spray test. Also, the elementary wire of 1 mmϕ was subjected to the same heat treatment as the above, which was measured for tensile strength, torsion value and fatigue strength. The results are shown in Tables 4 to 6.

As a comparative example, the bare wire of 1 mmϕ formed by drawing the above raw wire of 3.5 mmϕ, and the polyester coating elementary (color tone: red) wire was tested in the same manner as the above. The polyester coating elementary wire was formed by drawing the patented steel wire of 3.5 mmϕ to a diameter of 1 mmϕ and dipping it in a solution formed by diluting polyester paint by thinner, followed by baking by a two-bake/two-coat system. The results are shown in Table 3.

As is apparent form Tables 4 through 6, in the tight spring after heating, with the thickness of a lower Ni-layer being 2 μm or more and the thickness of Cu-Zn alloy layer being 2 μm or more, all of the tensile strength, torsion value characteristic, fatigue strength and corrosion resistance are preferable as an elementary wire for a spring. Also, this tight spring exhibits excellent corrosion resistance at a thinner thickness of the Cu-Zn alloy plating layer as compared to a spring having the Cu-Zn alloy plating layer without the lower Ni-plating layer. Further, when the thickness of the lower Ni-plating layer exceeds 30 μm and the thickness of the Cu-Zn alloy plating layer exceeds 25 μm, the corrosion resistance is not improved in proportion to the increase in the thickness.

TABLE 3

| Class | Plating thickness before heating (μm) Total | Cu | Zn | Heating condition °C. | min. | Zn in plating after heating (%) | Color tone before heating | after heating | Surface |
|---|---|---|---|---|---|---|---|---|---|
| Com- | 5 | 5 | 0 | 150 | 7 | 0 | red | red | Good |
| parative | 5 | 5 | 0 | 200 | 5 | 0 | red | red | (galling, |
| Example | 5 | 5 | 0 | 250 | 4 | 0 | red | red | discolor- |

TABLE 3-continued

| Class | Plating thickness before heating (μm) Total | Cu | Zn | Heating condition °C. | min. | Zn in plating after heating (%) | Color tone before heating | after heating | Surface |
|---|---|---|---|---|---|---|---|---|---|
| | 5 | 5 | 0 | 300 | 3.5 | 0 | red | red | ation, |
| | 5 | 5 | 0 | 400 | 2 | 0 | red | red | fusing: |
| | 5 | 4.75 | 0.25 | 150 | 7 | 5 | white | white | absence) |
| | 5 | 4.75 | 0.25 | 200 | 5 | 5 | white | white | |
| Working | 5 | 4.75 | 0.25 | 250 | 4 | 5 | white | gold | |
| Example | 5 | 4.75 | 0.25 | 300 | 3.5 | 5 | white | gold | |
| | 5 | 4.75 | 0.25 | 400 | 2 | 5 | white | gold | |
| Com- | 5 | 3.50 | 1.50 | 150 | 7 | 30 | white | white | |
| parative | 5 | 3.50 | 1.50 | 200 | 5 | 30 | white | white | |
| Example | | | | | | | | | |
| Working | 5 | 3.50 | 1.50 | 250 | 4 | 30 | white | gold | |
| Example | 5 | 3.50 | 1.50 | 300 | 3.5 | 30 | white | gold | |
| | 5 | 3.50 | 1.50 | 400 | 2 | 30 | white | gold | |
| Com- | 5 | 2.75 | 2.25 | 1.50 | 7 | 45 | white | white | |
| parative | 5 | 2.75 | 2.25 | 200 | 5 | 45 | white | white | |
| Example | | | | | | | | | |
| Working | 5 | 2.75 | 2.25 | 250 | 4 | 45 | white | gold | |
| Example | 5 | 2.75 | 2.25 | 300 | 3.5 | 45 | white | gold | |
| | 5 | 2.75 | 2.25 | 400 | 2 | 45 | white | gold | |
| Com- | 5 | 2.50 | 2.50 | 150 | 7 | 50 | white | white | |
| parative | 5 | 2.50 | 2.50 | 200 | 5 | 50 | white | white | |
| Example | 5 | 2.50 | 2.50 | 250 | 4 | 50 | white | white | |
| | 5 | 2.50 | 2.50 | 300 | 3.5 | 50 | white | white | |
| | 5 | 2.50 | 2.50 | 400 | 2 | 50 | white | white | |
| *1 | 100 | — | — | 200 | 5 | — | red | muddy red | *2 |

(Note)
*1 . . . comparative example (polyester coat)
*2 . . . galling, discoloration, fusing: presence

TABLE 4

| Spring steel material | Plating thickness (μm) Ni | Cu | Zn | Zn in Cu—Zn alloy plating after heating (%) | Wire diameter (mm) | Tensile strength ($N/mm^2$) | Torsion Test Torsion value | Fracture surface | Rusting time in salt spray (hr) | Remarks |
|---|---|---|---|---|---|---|---|---|---|---|
| Hard | 1 | 0 | 1.0 | 0 | 1.0 | 2130 | 25 | good | 4 | Compara- |
| steel | 1 | 0 | 0.95 | 0.05 | 5 | 1.0 | 2110 | 26 | good | 7 | tive |
| wire | 1 | 0 | 0.90 | 0.10 | 10 | 1.0 | 2110 | 25 | good | 6 | Example |
| (SWC) | 1 | 0 | 0.55 | 0.45 | 45 | 1.0 | 2080 | 25 | good | 7 | |
| | 1 | 0 | 0.5 | 0.5 | 50 | 1.0 | 2100 | 25 | good | 12 | |
| | 2 | 1 | 1.0 | 0 | 0 | 1.0 | 2100 | 24 | good | 4 | Compara- |
| | 2 | 1 | 0.95 | 0.05 | 5 | 1.0 | 2080 | 26 | good | 6 | tive |
| | 2 | 1 | 0.90 | 0.10 | 10 | 1.0 | 2070 | 26 | good | 6 | Example |
| | 2 | 1 | 0.55 | 0.45 | 45 | 1.0 | 2100 | 27 | good | 7 | |
| | 2 | 1 | 0.5 | 0.5 | 50 | 1.0 | 2100 | 24 | good | 10 | |
| | 4 | 0 | 3.6 | 0.4 | 10 | 1.0 | 2120 | 25 | good | 14 | Working |
| | 4 | 2 | 1.90 | 0.1 | 5 | 1.0 | 2100 | 25 | good | 16 | Example |
| | 4 | 2 | 1.80 | 0.2 | 10 | 1.0 | 2040 | 23 | good | 18 | |
| | 4 | 2 | 1.10 | 0.90 | 45 | 1.0 | 2050 | 21 | good | 48 | |
| | 4 | 2 | 1.0 | 1.0 | 50 | 1.0 | 2100 | 26 | good | 50 | Comparative Example |

TABLE 5

| Spring steel material | Plating thickness (μm) Total | Ni | Cu | Zn | Zn in Cu—Zn alloy plating after heating (%) | Wire diameter (mm) | Tensile strength ($N/mm^2$) | Torsion Test Torsion value | Fracture surface | Rusting time in salt spray (hr) | Remarks |
|---|---|---|---|---|---|---|---|---|---|---|---|
| Hard | 10 | 0 | 7 | 3 | 30 | 1.0 | 2100 | 25 | good | 40 | Working |
| steel | 10 | 5 | 4.75 | 0.25 | 5 | 1.0 | 2120 | 21 | good | 28 | Example |
| wire | 10 | 5 | 4.50 | 0.50 | 10 | 1.0 | 2080 | 23 | good | 32 | |
| (SWC) | 10 | 5 | 2.75 | 2.25 | 45 | 1.0 | 2060 | 23 | good | 75 | |
| | 10 | 5 | 2.5 | 2.5 | 50 | 1.0 | 2090 | 22 | good | 80 | Comparative |
| | 55 | 0 | 38.5 | 16.5 | 30 | 1.0 | 2040 | 26 | good | 60 | Example |
| | 55 | 30 | 23.75 | 1.25 | 5 | 1.0 | 2040 | 27 | good | 50 | Working |
| | 55 | 30 | 22.5 | 2.5 | 10 | 1.0 | 2030 | 24 | good | 55 | Example |
| | 55 | 30 | 13.75 | 11.25 | 45 | 1.0 | 2040 | 24 | good | 95 | |
| | 55 | 30 | 12.5 | 12.5 | 50 | 1.0 | 2040 | 24 | good | 100 | Comparative Example |

TABLE 6

| Spring steel material | Plating thickness (μm) Total | Ni | Cu | Zn | Zn in Cu—Zn alloy plating after heating (%) | Wire diameter (mm) | Tensile strength (N/mm²) | Torsion Test: Torsion value | Torsion Test: Fracture surface | Rusting time in salt spray (hr) | Remarks |
|---|---|---|---|---|---|---|---|---|---|---|---|
| Hard | 75 | 0 | 52.5 | 22.5 | 30 | 1.0 | 2010 | 26 | good | 75 | Comparative |
| steel | 75 | 40 | 33.25 | 1.75 | 5 | 1.0 | 2010 | 25 | good | 60 | Example |
| wire | 75 | 40 | 31.5 | 3.50 | 10 | 1.0 | 2030 | 25 | good | 65 | |
| (SWC) | 75 | 40 | 19.25 | 15.75 | 45 | 1.0 | 2010 | 26 | good | 100 | |
| | 75 | 40 | 17.5 | 17.5 | 50 | 1.0 | 2010 | 26 | good | 105 | |
| Bare wire | — | — | — | — | — | 1.0 | 2160 | 24 | good | 0.5 | |
| *1 | — | — | — | — | — | 1.2 | 2160 | 27 | good | *2 | |

(Note)
*1 . . . polyester coat wire
*2 . . . no rust after 300 hr

EXAMPLE 5

In the elementary wire of 1 mmϕ as shown in Example the whole plating thickness after drawing was set to be 4 μm and the thickness ratio of the Zn-layer to the total thickness of the Cu-layer and the Zn layer is changed to 0, 5, 10, 45, and 50%. Each wire was formed into a coil spring, followed by heating, and was examined for a colored state. The results are shown in Table 7 along with the manufacturing conditions such as the plating layer thickness and heating condition. As is apparent from Table 7, when the thickness ratio of the Zn-layer is selected as 10 to 45%, the Zn content in the Cu-Zn alloy plating layer after heat treatment becomes 10 to 45%. Thus, by the heat treatment under the condition of 250° C.×4 min. or more to 400° C.×2 min. or more, the color tone is changed into gold, which makes it possible to positively distinguish the spring steel formed products. Further, the present invention is superior to when a resin coating is used because the resin coating suffers from surface deterioration such as galling in forming, decoloration and fusing.

The present invention is not limited to a coil spring; but may be applied to a spring material that requires a low temperature annealing after forming (forming material, torsion spring and sheet spring and the like) or a material similar thereto.

TABLE 7

| Class | Plating thickness before heating (μm) Ni | Cu | Zn | Heating condition °C. | min. | Zn in Cu-Zn alloy plating (%) | Color tone before heating | after heating | Surface |
|---|---|---|---|---|---|---|---|---|---|
| Comparative Example | 4 | 0 | 4 | 0 | 150 | 7 | 0 | red | dark red | Good (galling, discoloration, fusing: absence) |
| | 4 | 0 | 4 | 0 | 200 | 5 | 0 | red | dark red | |
| | 4 | 0 | 4 | 0 | 250 | 4 | 0 | red | dark red | |
| | 4 | 0 | 4 | 0 | 300 | 3.5 | 0 | red | dark red | |
| | 4 | 0 | 4 | 0 | 400 | 2 | 0 | red | dark red | |
| Comparative Example | 4 | 2 | 1.90 | 0.10 | 150 | 7 | 5 | white | white | |
| | 4 | 2 | 1.90 | 0.10 | 200 | 5 | 5 | white | white | |
| | 4 | 2 | 1.90 | 0.10 | 250 | 4 | 5 | white | white | |
| | 4 | 2 | 1.90 | 0.10 | 300 | 3.5 | 5 | white | white | |
| | 4 | 2 | 1.90 | 0.10 | 400 | 2 | 5 | white | white | |
| | 4 | 2 | 1.80 | 0.20 | 150 | 7 | 10 | white | white | |
| | 4 | 2 | 1.80 | 0.20 | 200 | 5 | 10 | white | white | |
| Working Example | 4 | 2 | 1.80 | 0.20 | 250 | 4 | 10 | white | gold | |
| | 4 | 2 | 1.80 | 0.20 | 300 | 3.5 | 10 | white | gold | |
| | 4 | 2 | 1.80 | 0.20 | 400 | 2 | 10 | white | gold | |
| Comparative Example | 4 | 2 | 1.10 | 0.90 | 150 | 7 | 45 | white | white | |
| | 4 | 2 | 1.10 | 0.90 | 200 | 5 | 45 | white | white | |
| Working Example | 4 | 2 | 1.10 | 0.90 | 250 | 4 | 45 | white | gold | |
| | 4 | 2 | 1.10 | 0.90 | 300 | 3.5 | 45 | white | gold | |
| | 4 | 2 | 1.10 | 0.90 | 400 | 2 | 45 | white | gold | |
| Comparative Example | 4 | 2 | 1.0 | 1.0 | 150 | 7 | 50 | white | white | |
| | 4 | 2 | 1.0 | 1.0 | 200 | 5 | 50 | white | white | |
| | 4 | 2 | 1.0 | 1.0 | 250 | 4 | 50 | white | white | |
| | 4 | 2 | 1.0 | 1.0 | 300 | 3.5 | 50 | white | white | |
| | 4 | 2 | 1.0 | 1.0 | 400 | 2 | 50 | white | white | |
| *1 | | | — | — | 200 | 5 | — | red | dark red | *2 |

(Note)
*1 . . . polyester coat
*2 . . . galling, discoloration, fusing: presence

We claim:

1. A method for facilitating the distinction among different spring steel products and at the same time improving their surface appearance and corrosion resistance, comprising plating the surface of said different spring steel products before spring-forming with alternate layers of Cu and Zn, the amount of Cu and Zn differing for steel products differing in size and/or material, to obtain color- developable spring steel products, drawing and then coil spring-forming the resulting plated spring steel products, and low temperature annealing said resulting plated spring steel products to develop their colors, the colors being different for spring steel products differing in size and/or material, whereby mixing and erroneous assembly of spring steel products differing in size and/or material is prevented.

2. A method for facilitating the distinction among different spring steel products and at the same time improving their surface appearance and corrosion resistance, comprising plating the surface of said different spring steel products before spring-forming with alternate layers of a lower layer of Ni, an intermediate layer of Cu and an upper layer of Zn, the amount of Cu and Zn differing for steel products differing in size and/or material, to obtain color- developable spring steel products, drawing and then coil spring-forming the resulting plated spring steel products, and low temperature annealing said resulting plated spring steel products to develop their colors, the colors being different for spring steel products differing in size and/or material, whereby mixing and erroneous assembly of spring steel products differing in size and/or material is prevented.

3. The method according to claim 1 or 2, wherein the low temperature annealing is at 250°–400° C.

4. The method according to claim 1 or 2, wherein the heating time in said low temperature annealing is set to a time <t> satisfying the following equation (1), $$\log t \geqq 1.193-2.386\times 10^{-3}T \quad (1)$$

wherein T indicates a heating temperature (° C.) in a low temperature annealing, and <t> is a heating time (min.).

5. The method according to claim 1 or 2, wherein either of a hard drawn steel wire, piano wire or a spring stainless steel wire is used as said spring steel material.

6. The method according to claim 1 or 2, wherein the alternate layers of Cu and Zn are composed of 10–45% wt. Zn, the remainder Cu, exhibiting a color tone of gold after annealing.

7. The method according to claim 1 or 2, wherein the alternate layers of Cu and Zn are composed of 5–10% wt. Zn, the remainder Cu, exhibiting a color tone of red copper after annealing.

8. The method according to claim 1 wherein the total thickness of the layers is 2 to 25 μm.

9. The method according to claim 2, wherein the total thickness of the Cu and Zn layers is 2–25 μm and of Ni is 2–30 μm.

* * * * *

UNITED STATES PATENT AND TRADEMARK OFFICE

CERTIFICATE OF CORRECTION

PATENT NO. : 5,380,407
DATED : January 10, 1995
INVENTOR(S) : Yukio Yamaoka et al It is certified that error appears in the above-indentified patent and that said Letters Patent is hereby corrected as shown below:

On the title page:

In the Abstract, line 9, delete "taken" and insert --then--.

Column 1, line 50, delete "7.3" and insert --7:3--.

Column 4, line 8, delete "2,386" and insert --2.386--.

Column 13, line 20, after "ple", insert --4,--.

Signed and Sealed this

Eighth Day of August, 1995

Bruce Lehman

*Attest:*

BRUCE LEHMAN

*Attesting Officer*

*Commissioner of Patents and Trademarks*